US006080985A

United States Patent [19]

Welkie et al.

[11] Patent Number: 6,080,985

[45] **Date of Patent: *Jun. 27, 2000**

[54] ION SOURCE AND ACCELERATOR FOR IMPROVED DYNAMIC RANGE AND MASS SELECTION IN A TIME OF FLIGHT MASS SPECTROMETER

[75] Inventors: David G. Welkie, Trumbull; Dar Bahatt, Stamford, both of Conn.

[73] Assignee: The Perkin-Elmer Corporation, Norwalk, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/940,576

[22] Filed: Sep. 30, 1997

[51] Int. Cl.[7] ..... H01J 49/40

[52] U.S. Cl. ..... 250/287; 250/286; 250/288

[58] Field of Search ..... 250/287, 288

[56] References Cited

U.S. PATENT DOCUMENTS

| | | | |
|---|---|---|---|
| 2,685,035 | 7/1954 | Wiley | 250/41.9 |
| 3,307,033 | 2/1967 | Vestal | 250/287 |
| 3,502,867 | 3/1970 | Beauchamp | 250/41.9 |
| 3,668,384 | 6/1972 | Moorman et al. | 250/287 |
| 3,992,632 | 11/1976 | Kruger et al. | 250/423 |
| 4,166,952 | 9/1979 | Colby et al. | 250/288 |
| 4,321,467 | 3/1982 | Buttrill | 250/288 |
| 4,459,481 | 7/1984 | Todd et al. | 250/298 |
| 4,535,235 | 8/1985 | McIver | 250/282 |
| 4,755,671 | 7/1988 | Friedland | 250/298 |
| 4,769,540 | 9/1988 | Mitsui et al. | 250/288 |
| 4,808,820 | 2/1989 | Blau | 250/281 |
| 4,853,539 | 8/1989 | Hall et al. | 250/288 |
| 4,948,962 | 8/1990 | Mitsui et al. | 250/288 |
| 4,996,424 | 2/1991 | Mimura et al. | 250/288 |
| 5,015,845 | 5/1991 | Allen et al. | 250/288 |
| 5,107,109 | 4/1992 | Stafford et al. | 250/282 |
| 5,117,107 | 5/1992 | Guilhaus et al. | 250/287 |
| 5,196,700 | 3/1993 | Kameshima | 250/288 |
| 5,245,186 | 9/1993 | Chait et al. | 250/288 |
| 5,572,022 | 11/1996 | Schwartz et al. | 250/282 |

OTHER PUBLICATIONS

Kwang Woo Jung et al: "An Electron–Impact Ionization Time–of–Flight Mass Spectrometer Using a Simple High–Voltage Square Pulse Generator" Review of Scientific Instruments, vol. 62, No. 9, Sep. 1, 1991, pp. 2125–2130.

John Coles et al: "Orthogonal acceleration—a new direction for time–of–flight mass spectometry: fast, sensitive mass analysis for continuous ion sources", Trends in Analytical Chemistry, vol. 12, No. 5, 1993, pp. 203–213.

(List continued on next page.)

*Primary Examiner*—Jack Berman
*Attorney, Agent, or Firm*—Perman & Green, LLP

[57] ABSTRACT

In a mass spectrometer, an ion source in combination with an accelerator comprising an electron source, a gate electrode constructed so as to block the flow of electrons from the source when a potential is applied, a sample introduction means for transporting carrier gas containing analytes, an ionization chamber positioned to receive the flow of electrons and the carrier gas, wherein the flow of electrons ionizes the carrier gas, a pulsed accelerator, and an ion transfer region situated so that the ionized carrier gas travels from the ionization chamber, through the ion transfer region and into an accelerator. The gate electrode and the pulsed accelerator are controlled in a timed relationship to control the amount off carrier gas being ionized and traveling into the accelerator between accelerator pulses so as to improve the dynamic range of the mass spectrometer and to selectively accelerate a particular mass range.

33 Claims, 3 Drawing Sheets

OTHER PUBLICATIONS

W.C. Wiley et al: "Time–of–Flight Mass Spectrometer with Improved Resolution" The Review of Scientific Instruments, vol. 26, No. 12, Dec. 1955 pp. 1150–1157.

James G. Boyle et al: "An Ion–storage Time–of–flight Mass Spectrometer for Analysis of Electrospray Ions" Rapid Communications in Mass Spectrometry, vol. 5, 400–405 (1991).

Benjamin M. Chien et al: "Plasma Source Atmospheric Pressure Ionization Detection of Liquid Injection Using an Ion Trap Storage/Reflectron Time–of–Flight Mass Spectrometer", Anal. Chem. 1993, 65, pp. 1916–1924.

D.J. Beussman et al: "An Interleaved–Comb Ion Deflection Gate".

Anatol N. Verentchikov, et al: "Reflecting Time–of–Flight Mass Spectometer with an Electrospray Ion Source and Orthogonal Extraction", Analytical Chemistry, vol. 66, No. 1, Jan. 1, 1994, pp. 126–133.

J.H.J. Dawson, et al: "Orthogonal–acceleration Time–of–flight Mass Spectrometer", Rapid Communications in Mass Spectrometry, vol. 3, No. 5, 1989 pp. 155–159.

P. Grivet, "Electron Optics", Pergamon Press, Part II (12.2) "Formation of the Spot", pp. 269–271.

Kwang Woo Jung, et al: "An electron–impact ionization time–of–flight mass spectrometer using a simple high–voltage square pulse generator" Rev. Sci. Instrum., vol. 62, No. 9, Sep. 1991, pp. 2125–2130.

ION SOURCE AND ACCELERATOR FOR IMPROVED DYNAMIC RANGE AND MASS SELECTION IN A TIME OF FLIGHT MASS SPECTROMETER

FIELD OF THE INVENTION

This invention generally relates to a combination of a pulsed electron ionization source and a pulsed accelerator in a time-of-flight mass spectrometer, where the number of ions entering the accelerator is controlled so as to increase the dynamic range of the mass spectrometer, and the timing between the production of ions and the acceleration pulse of the accelerator is controlled to achieve mass selectivity.

BACKGROUND OF THE INVENTION

Time-of-flight mass spectrometers are known for their high transmission, good mass resolution, and fast analysis time. They are therefore potentially advantageous in situations that require fast mass spectral acquisitions, such as in fast gas chromatography/mass spectrometry (GC/MS) analyses, compared to conventional mass spectrometers, such as quadrapole mass filters and ion trap mass spectrometers.

In order to perform mass analysis of gas molecules, e.g., the effluent from a GC, the gas molecules must first be ionized, which is the function of an ion source. An efficient ion source will convert as many sample molecules into ions as possible and produce an optimal beam for the type of analyzer being used. The most common type of ion source for GC/NMS instruments is an 'electron ionization source'. In this type of source, the gaseous sample stream is introduced into a chamber, which is itself contained in the evacuated housing of the mass spectrometer. Electrons are typically produced by thermal emission from a hot filament located outside the chamber. The electrons are accelerated through an electric field to a particular and relatively homogeneous energy, as defined by the potential difference between the filament and the ion source chamber. This is typically 70 eV, but can vary from about 10 eV to upwards of 150 eV. The electrons are directed into and through the chamber. When an electron collides with a sample gas molecule in the chamber, one possible (desirable) result is that the gas molecule loses an electron and therefore becomes a positively charged ion. Once the sample molecule acquires a charge, it can respond to electrostatic fields that accelerate it out of the ion source and guide it into the entrance of the mass spectrometer.

In the case of a time-of-flight mass spectrometer, the entrance region consists of a pulsed acceleration region, in which an electrostatic field can be turned on and off with fast transitions. While this electrostatic field is kept off, ions from the ion source are allowed to enter this acceleration region. When the electrostatic field is turned on, the effect of the field causes the ions to be accelerated into a field-free flight tube of the mass spectrometer, where they travel until they reach a detector or mass analyzer. Sometimes an electrostatic mirror is deployed after some distance along the flight tube, in which the ions reverse direction, and continue through a second segment of field-free flight tube before reaching the detector or mass analyzer. Because the ions are accelerated to the same nominal energy, their flight velocity will be proportional to the square root of their mass. Over the fixed (effective) length of the flight tube, then, the measured spectrum of charge intensity vs. arrival time represents the mass spectrum of ions initially contained in the acceleration region. This mass spectrum is obviously related to the relative concentrations of ions in the ion source, which, in turn, reflects the chemical constituents in the gaseous effluent from the gas chromatograph (or other source of gas to be mass analyzed).

It is most advantageous that the ions enter the time-of-flight acceleration region traveling in a direction that is orthogonal to the time-of-flight flight tube axis. Ions in the acceleration region will be accelerated in a direction parallel to the flight tube axis and perpendicular to the ions' initial direction of travel. Since the time-of-flight acceleration region is of a limited dimension along the ions' initial direction of travel, only ions within the boundaries of this region will enter the flight tube and be analyzed. After this analysis cycle has completed, the field in the acceleration region is turned off, and the beam of ions from the source is then allowed to enter the acceleration region. Then, again, at a pre-determined time, the field is pulsed on and the analysis cycle repeats. The spectrum from each individual cycle could be preserved separately, but, typically, several hundreds of such mass spectra are acquired and integrated to increase the signal/noise characteristics.

Now, GC/MS applications frequently require that ion intensities be measured over a signal dynamic range of up to six or seven orders of magnitude. This results from the fact that signal intensities from the different ion masses present at any one time can typically extend over several orders of magnitude from one mass ion to another, and, in addition, ion intensities will vary over time as the chromatographic effluent gas concentration varies in the ion source by several orders of magnitude. While the detectors and acquisition electronics of conventional quadrapole mass filters are capable of realizing such dynamic range performance, the specialized detectors and acquisition electronics necessary for time-of-flight mass spectrometry are currently not able to achieve this amount of dynamic range with any one fixed setting of the gain in the detection system. That is, when the overall gain in the time-of-flight detection system is adjusted so that the smallest signal levels of interest (i.e., a single ion of any mass) are measurable, then the highest signals, which also need to be accommodated, will saturate the detection system, and hence will not be measurable under these gain conditions. Similarly, if the gain in the detection/acquisition system is adjusted so that the largest signals of interest are accommodated, then signals of interest in the lower intensity ranges will not be detectable.

Obviously, one approach to accommodate all signal levels of interest with time-of-flight mass spectrometers is to adjust the gain of the time-of-flight detector between spectral acquisitions by adjusting its voltage. In this way, a composite spectrum could be constructed by combining the individual spectra acquired with different gain settings. There are at least two difficulties with this approach: 1) the gain vs. detector voltage relationship would have to be well known and stable in order for the measurement to be quantitative, and this would be difficult on a routine basis because of the non-linear, and variable, relationship between the gain of a detector and the applied detector voltage; and, 2) in order to be compatible with 'fast' spectral acquisitions, the voltage changes would have to occur at the ~2 kV level with relatively sharp transition and settling times, which would involve significant additional complexity and expense.

Another approach to accommodate a wider range of signal levels would be to vary the ion source electron beam current. That is, when intense signals are present, the electron beam current could be reduced, and the probability that a gas molecule is ionized is correspondingly reduced. Similarly, when the mass peaks of interest are weak, the electron beam current could be increased to effectively increase the ionization probability, or efficiency.

There are at least two difficulties with this approach: 1) for the measurements to be interpreted with an acceptable degree of quantification requires accurate and precise control over the electron beam current. Such control would be achieved by measuring the electron beam current, and using this measurement in a 'feedback' loop, to regulate the emission from the electron source filament, either by adjusting the filament current, or by adjusting the voltage on a control grid electrode near the filament, in a well known fashion. The problem here is that the response time of such feedback schemes is much slower, typically of the order of tenths of a second or longer, depending on the electron current being measured, than would be required to be compatible with 'fast' chromatographic time resolutions, which would commonly be of the order of tens of milliseconds or less. 2) Another problem arises from the fact that the electron beam, which consists of negative charges, distorts electrostatic fields along and around its path. In the ion source chamber, gas molecules are ionized by collisions with the electron beam and the ions are directed out of the chamber by a weak electrostatic field. This initial extraction field is weak causing a small energy divergence in the ion beam, and in turn, the electron beam introduces a small but significant distortion of this weak electrostatic field. The resulting ion beam is subsequently controlled by electrostatic focusing optics. Optimization of these optics depends sensitively on the energy and angular emission characteristics of the ion beam as it leaves the source chamber, which, in turn, depends on the detailed spatial dependence of the electrostatic field in the chamber. Provided that the electron beam current is constant, the distortion of the field will be constant, and the down-stream focusing optics can be adjusted to take the effect of this distortion on ion trajectories into account. However, if the electron beam current is adjusted as described above to accommodate a wider range of signal intensities, the result would be a variable distortion of the electrostatic field in the ion source, which would degrade the quality of the focusing of the ion beam.

An additional problem sometimes occurs in GC/MS and other similar instruments that the most intense mass peaks in the mass spectrum originate from chemical species in the sample gas that are of no interest in the analysis, such as from the GC carrier gas, solvent species, or other unimportant constituents. Often, such intense mass peaks can interfere with the quality of the analysis, for example, due to possible detector saturation and recovery problems, amplifier overload, space charge effects in the mass analyzer, etc. Such intense mass peaks are eliminated in the current art by introducing an electrostatic gate in the flight tube of the time-of-flight mass analyzer. Such gates are activated to prevent unwanted ions from reaching the detector. They usually involve an array of fine wires in the flight path, and, as such, have the disadvantages of: 1) reducing the transmission of the analyzer; 2) introducing surfaces in the flight path which eventually become contaminated with a thin insulating layer, and so may exhibit charging and degrade performance; and, 3) additional mechanical and electronic complexity and expense.

SUMMARY OF THE INVENTION

According to the invention there is disclosed an ion source having a controllable electron beam used in combination with the pulsed accelerator of a time-of-flight mass analyzer. The ion source is constructed so that the electron beam bombarding the sample may be pulsed, that is, the electron beam may be gated on with a fast transition time, to a constant, regulated beam current, for a predetermined amount of time, and then gated off with a similarly fast transition time. The result is that the ion source produces a pulsed ion beam composed of discrete ion packets. The electron beam is pulsed in a timed relationship with the acceleration pulses of the time-of-flight accelerator.

It is an object of the invention to improve the dynamic range of a time-of-flight mass spectrometer by utilizing the pulsed electron beam to control the duration of the ion packets entering the time-of-flight accelerator between acceleration pulses. When ion intensities are greater than the dynamic range capabilities of the time-of-flight detection system, the duration of the ion packets, and hence the number of ions contained in each packet, is reduced by a well-defined factor. Likewise, for very low signal levels, the duration of the ion packets, and the number of ions in each packet, are increased by a well-defined factor.

It is a further object of the invention to precisely select the mass range being extracted by the time-of-flight accelerator by controlling the timing between the electron beam modulation pulses and the time-of-flight acceleration pulses. Knowing the distance the ions will travel before being accelerated into the time-of-flight mass analyzer, and the velocity of the various mass ions in the ion beam from the ion source to the time-of-flight acceleration region, allows a particular mass range to be selectively accelerated toward the detector.

DETAILED DESCRIPTION OF THE INVENTION

Figure 1:
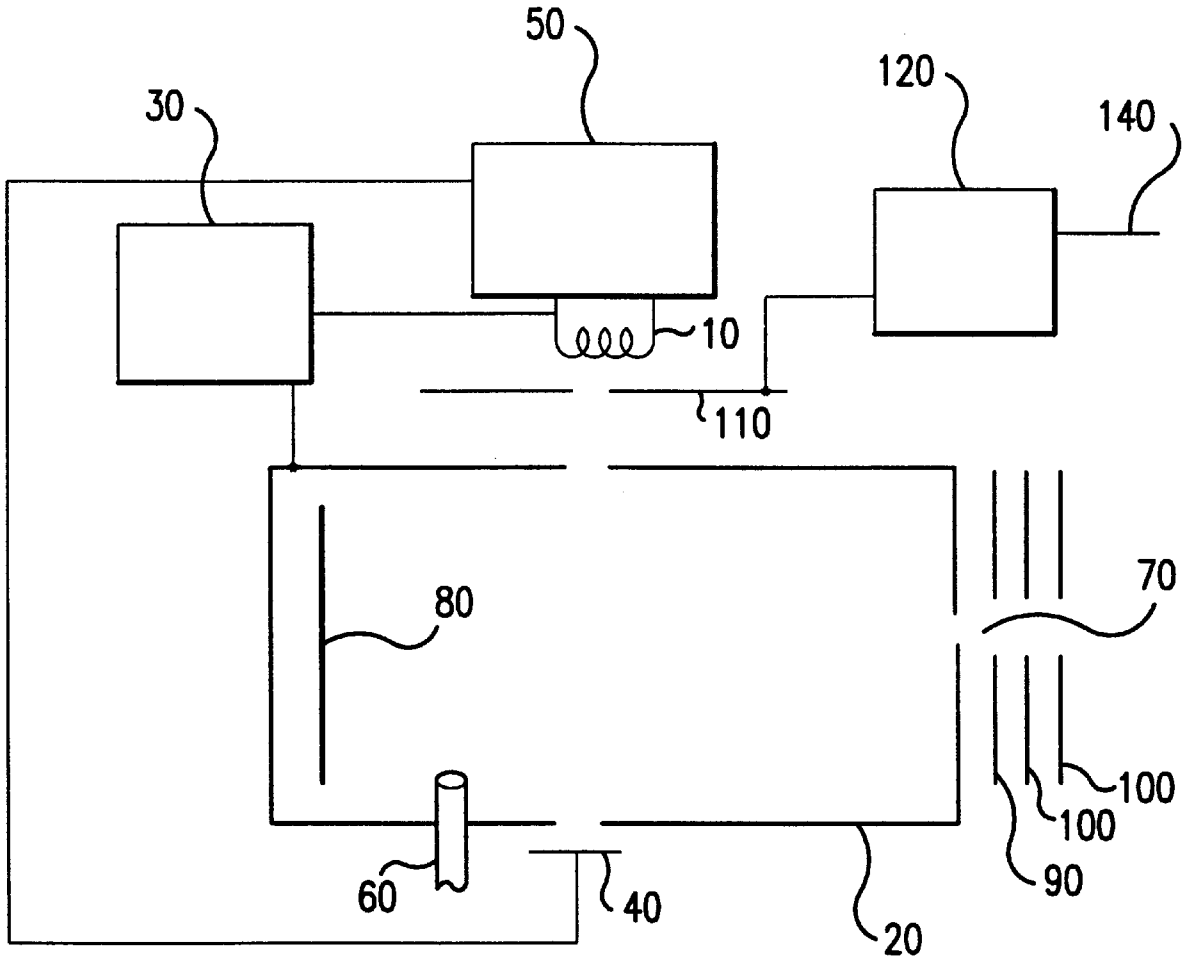
FIG. 1 is a block diagram of the ionizer.

FIG. 1 schematically illustrates the electron ionization source. Electrons are emitted from a hot filament 10, and accelerated toward and through an ionization chamber 20. The energy of the electrons is determined by voltage supply 30, which develops a potential difference between the filament and the ionization chamber. The electron beam is intercepted by an anode 40. The anode 40 provides the measured electron current to be used as a feedback signal to a regulated filament current supply 50, resulting in a stable electron beam at a selected beam current. A gaseous sample is introduced into the ionization chamber through a sample introduction means 60. Ions created in the ionization chamber are accelerated out through the ionization chamber exit port 70 due to the electrostatic field developed by the combined action of the potentials on a pusher plate 80, the ionization chamber 20, the ion source extraction electrode 90, and other possible focusing electrodes 100 in the vicinity of the exit port 70.

An additional electrode 110 is located between the filament and the ionization chamber. This 'control' electrode is positioned to be capable of blocking the electrons from entering the ionization chamber, and is constructed so that electrons may be blocked, or unblocked, within a very short response time, using only a few volts of bias on the electrode. The electrode is constructed of one or a combination of various configurations which may accomplish such fast electrostatic electron beam gating such as: 1) a simple wire mesh grid, with its plane normal to the electron beam axis, which has a retarding potential applied that blocks the electron beam; 2) a so-called Bradbury-Nielsen gate, consisting of two interlaced arrays of fine wires, where opposite potentials are applied to each array so as to deflect electrons traveling between any two grid wires, preventing electrons from entering the ionization chamber; 3) various forms of coaxial electrostatic deflectors which act to deflect the entire electron beam from the entrance of the ionization chamber; or, 4) a so-called Wehnelt electrode, commonly used to surround the filament of electron guns except for a small hole near the filament through which the electron beam emerges, and which is known to be capable of switching the electron beam 'on' and 'off' with fast transition times using only several volts difference between the electron beam 'on' state and the 'off' state.

The control electrode 110 is connected to the output of a signal generator 120, which applies, or removes, the blocking bias voltage in response to a signal on the signal generator 'trigger' input 140. The amplitude of the blocking bias voltage applied to the electrode is selected so that, when applied, electrons are completely blocked, and when removed, electrons flow freely, and ionization of sample gas molecules occurs.

The advantage of blocking the electron beam to indirectly control the output of the ion source as opposed to blocking the output of the ion source directly, is that much smaller transition times result if the electron beam is blocked, compared to blocking the ion beam, all other factors being equal. This is due to the fact that ions are at least 10,000 times more massive than electrons, and therefore electrons travel at least 100 times faster than ions at comparable energies. Consequently, transition times in the stopping and starting of electron beams are at least 100 times faster than for ion beams.

For example, an electron with a typical energy of 70 eV has a velocity of about 5 mm/nS. If a potential barrier gradient with a height of 70 V is suddenly introduced over a length of 1 mm in the path of a beam of such electrons, all electrons that are within this 1 mm at the time the potential gradient is introduced have enough energy to surmount the barrier and continue on, albeit at reduced energy. As a result, the transition time for turning the beam on (or off) is on the order of the time required for electrons to travel through the 'gate' region of 1 mm, or about 0.2 nS. This is substantially shorter than the time generally required by the actual signal generator electronics to generate the potential gradient, which becomes the limiting factor governing the pulse transition time. In contrast, if the same approach were taken to directly interrupt an ion beam, the situation would be much different. For example, an ion of mass 100 amu with an energy of 70 eV has a velocity of about 0.012 mm/nS. Therefore this ion would require about 85 nS to traverse the 1 mm of the potential 'gate region', and the transition times of an ion pulse produced this way would be of this same order of magnitude, clearly much longer than for the electron pulse.

The transition times achieved in turning the ionization process on and off are important in the context of applying this capability to improve the dynamic range of the signal intensity measurements. The reason for this is that the transition times determine the shortest duration ion pulse packets that are produced while maintaining predictable scaling between the ion packet pulse duration and the number of ions in the packet; this shortest ion packet duration realized correspondingly determines the maximum amount by which the signal intensities in each time-of-flight measurement cycle are attenuated with a quantitatively predictable scale factor. Electron beam gating means are utilized that produce gating transition times on the order of a few nanoseconds or less. Consequently, the minimum, quantitatively useful ion beam pulse packet durations that are achieved are of the order of 50–100 nS, or less.

Figure 2:
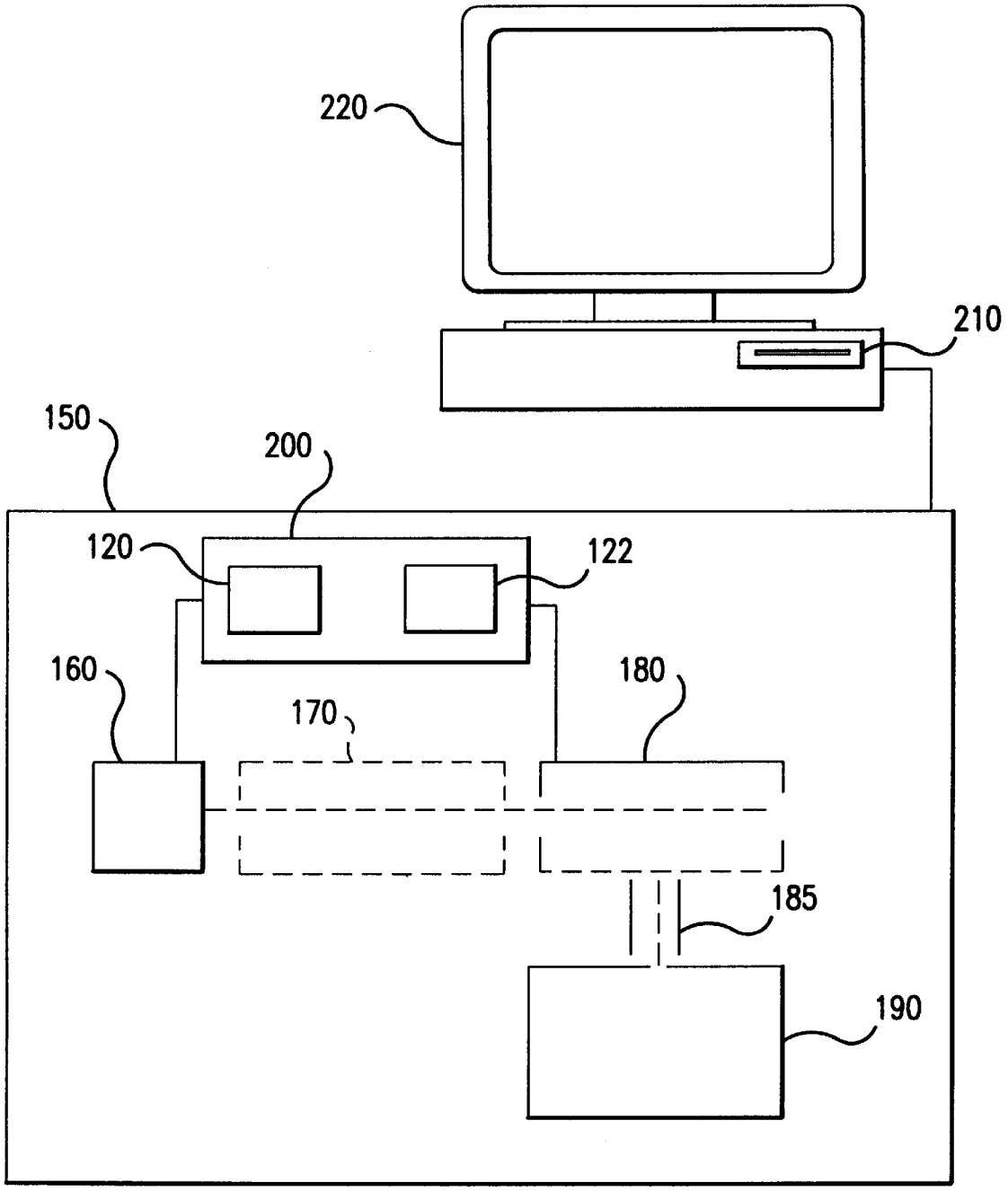
FIG. 2 is a block diagram of a mass spectrometer incorporating the ionizer, an ion transfer region, an orthogonal accelerator and a detector or mass analyzer.

The maximum duration of such ion beam packets that can be produced by the pulsed ion source described above is essentially unlimited. However, the maximum useful duration, in the context of this invention, is limited by the ability of the pulsed acceleration region to accommodate the physical length of the ion packets so produced. FIG. 2 shows a block diagram of the invention as used in a mass spectrometer 150 having a pulsed ionizer 160, an ion transfer region 170, an accelerator region 180, a flight tube 185 and a detector or mass analyzer 190. The ionizer and accelerator are controlled by a control means 200 consisting of a plurality of synchronized signal generators 120 and 122. The entire mass spectrometer is controlled by program means 210 residing on a digital computer 220. The ion packets are produced by the ionizer 160, travel through the ion transfer region 170, through the accelerator 180 and are selectively directed through the flight tube 185 toward the detector or mass analyzer 190. The ion transfer region may contain electrostatic optical devices for focusing, shaping, and/or steering the ion beam in a well-known manner in order to optimize the acceptance of the ion beam by the mass spectrometer. The physical length of an ion packet, once it reaches the initially field-free pulsed acceleration region of a time-of-flight mass analyzer, is given by $$l_{ion}=T_{el}\times V_{ion}, \tag{1}$$

where $l_{ion}$ is the physical length of an ion packet of ions of mass M, $T_{el}$ is the duration of the electron ionization pulse, and $V_{ion}$ is the velocity of the ion of mass M. $V_{ion}$ depends on the energy of the ions, $E_{ion}$, and their mass, M, according to $$V_{ion}=1.39\times10^{6}\times(E_{ion}/M)^{1/2} \tag{2}$$

where $E_{ion}$ is given in eV, M is given in amu, and $V_{ion}$ is in units of cm/s. Substituting this expression in Eq. (1) gives $$l_{ion}=1.39\times10^{6}\times T_{el}\times(E_{ion}/M)^{1/2} \tag{3}$$

As Eq. (3) indicates, the length of an ion packet is proportional to the ionization pulse duration, the energy of the ion beam, and the mass of the ion. For a given ion beam energy, $E_{ion}$, and for a particular mass, M, the maximum duration, $T_{el\ max}(M,E_{ion})$, that can be accommodated by the time-of-flight acceleration region of a length $L_{acc}$ is given by $$T_{el\ max}(M,E_{ion})=(L_{acc}/1.39\times10^{6})\times(M/E_{ion})^{1/2} \tag{4}$$

For typical values of $L_{acc}$=4 cm, an ion energy $E_{ion}$=10 eV, and for mass M=100 amu, the maximum ionization pulse duration that is useful in terms of improving the dynamic range is $T_{el\ max}(M,E_{ion})$=9.1 uS. In this case, the dynamic range is improved by approximately two orders of magnitude in the following way: The maximum pulse duration of 9.1 uS (or, in fact, a continuous ion beam) is used when the intensity of the mass 100 peak is low enough to fall within the dynamic range of the detection system, which is operating at the maximum gain consistent with the maximum available dynamic range capability. When the intensity of the mass 100 peak is greater than can be accommodated within the dynamic range of the detection system, the pulse duration is reduced accordingly to less than 9.1 uS, thereby reducing the number of ions in each pulse by a known factor, ensuring that the measured signal intensities remains within the signal dynamic range limits of the detection system. Because the pulse duration, hence, signal intensity, are attenuated by an accurately known factor, the corresponding measured signal intensities are scaled to be consistent with un-attenuated measurements. As discussed above, the ionization pulse duration can be reduced to at least 50–100 nS, thereby allowing an improvement in the signal dynamic range by about 2 orders of magnitude or more over a system using a detector alone.

If a pulse generator capable of generating precisely timed signals is not available, an alternate method is to generate a pulse train at a specific frequency and duty cycle and to vary the number of pulses applied to the gate electrode.

Enhanced selectivity of the mass range directed to the time-of-flight detector is also realized by controlling the amount of time delay between the electron beam pulse and the acceleration pulse of the time-of-flight accelerator. Some time delay between the electron ionization pulse and the time-of-flight acceleration pulse is necessary because the ions require a certain amount of time to travel from the point at which they were created in the ion source, through the ion transfer region, and to the time-of-flight acceleration region. This time delay depends on the mass of the ion, the distance between the point of ionization and the time-of-flight acceleration region, and the electrostatic fields that the ion experiences in the ion transfer region. Considering that all ions will ultimately acquire a kinetic energy equal to the difference between the nominal potential of the ion source and that of the time-of-flight acceleration region (represented by $E_{ion}$ in Eq. (2)), an effective transfer region length, $L_{transfer}$, is defined as $$L_{transfer}=V_{ion}(M)\times T_{transfer}(M) \quad (5)$$

where $V_{ion}(M)$ is the velocity of an ion of mass M as it enters the time-of-flight acceleration region, given by Eq. (2), and $T_{transfer}(M)$ is the actual time it takes an ion of mass M to traverse the transfer region between the point of ion creation and the entrance to the time-of-flight acceleration region. $L_{transfer}$ is the length over which an ion of mass M travels in time $T_{transfer}$ if it maintains a constant velocity equal to $V_{ion}$ in a field free region. Assuming that all ions experience the same electrostatic fields in the transfer region, the effective path length $L_{transfer}$ is the same for ions of all masses. It is apparent from Eq. (5) that ions of different masses take different amounts of time to traverse the transfer region—lighter masses will travel with greater velocities and arrive at the acceleration region earlier than heavier masses. Such separation of the ion packets continues similarly within the acceleration region as well. Consequently, at any point in time after the ionization pulse, the ion packets for the various mass ions are dispersed in space, and the degree of such mass dispersion increases with time. If, at some well-defined time after the ionization pulse occurs, the time-of-flight acceleration field is turned on, then those ions which are located within the acceleration region are injected into the flight tube 185 and eventually are detected by detector 190. The timing of the activation of the acceleration field is chosen so as to exclude those ions with a high enough velocity (small enough mass) that they have completely traversed the acceleration field before it is activated. Similarly, ions are also prevented from entering the flight tube with velocities low enough (large enough masses) that they have not reached the acceleration region entrance before the acceleration field is activated. By proper selection of the time delay between the activation of the ionizing electron beam pulse and the activation of the time-of-flight acceleration field, the mass range of ions accelerated toward the detector is precisely selected. In this manner, ions that are of no interest, and which are potentially detrimental to the analysis, are eliminated. This capability is particularly useful in the relatively common situation in which intense peaks occur in a segment of the mass spectrum that does not also include mass peaks that originate from the analyte masses of interest.

As an example, a certain analytical application requires a mass spectrum to be acquired for a particular sample gas eluting from a gas chromatograph, where the important mass peaks occur over a mass range of 35 amu to 300 amu. Helium is used as the carrier gas in the GC, in which case a relatively large mass peak occurs at mass 4 amu corresponding to the helium ion. Because the helium gas concentration is typically orders of magnitude larger than any analyte gas of interest, the helium ion intensity is so great so as to distort at least a substantial portion of the mass spectrum, if not the entire spectrum. Reasons for this distortion may be: substantial electronic ringing in the detection system after such a large signal, saturation and subsequent dead-time effects in the detector and/or detection electronics, as well as possible 'space charge' coulombic field effects originating from the high charge density associated with the helium ions, which may adversely affect the trajectories of other ions in the analyzer. Suppose further that an electron ionization pulse duration of 1 uS is used, that the ion beam energy is 10 eV in the time-of-flight acceleration region, that the effective distance between the ion source and the acceleration entrance is 2 cm, and that the length of the acceleration region is 5 cm. In order to eliminate the helium mass 4 amu ions, the trailing edge of the ion packet associated with this ion must just exit the acceleration region before the acceleration pulse occurs to direct the slower, higher mass ions into the mass analyzer. The time delay between the rising edge of the ionization pulse from the signal generator 120 and the rising edge of the acceleration pulse from the signal generator 122, then, corresponds to the time required for the trailing edge of the mass 4 amu ion packet to travel through the transfer region a distance of 2 cm, through the acceleration region a distance of 5 cm, for a total flight distance of 7 cm, in addition to the time of duration of the ionization pulse of 1 uS. The time required to travel 7 cm for a mass 4 amu ion at an energy of 10 eV is determined from Eqs. (2) and (5) to be 3.185 uS. The total time delay, then, is 3.185 uS+1.0 uS=4.185 uS, in order for the mass 4 amu be completely eliminated from the measurement.

With the parameters of the above example, a limited range of masses are accepted by the time-of-flight mass analyzer. The lowest mass ion theoretically accepted with no attenuation corresponds to the ion mass packet for which the leading edge of the packet just reaches the exit of the accelerator when the acceleration pulse occurs. These ions travel the 7 cm distance from the ion source to the accelerator exit within the 4.185 uS delay time, which determines the required velocity to be (7 cm / 4.185 uS). The mass of the ions with this velocity and 10 eV of energy is deduced from Eq. (2) to be about 6.9 amu. Similarly, the highest mass ion accepted with no attenuation corresponds to the ion mass packet for which the trailing edge just traverses the entrance to the acceleration region when the acceleration pulse is applied. This means that the trailing edge of these ions travel the 2 cm distance of the transfer region in 3.185 uS (i.e., the total delay time of 4.185 uS minus the ionization duration of 1 uS corresponding to the trailing edge of the ion packets). The velocity of these ions, then, is 2 cm/3.185 uS. The mass of ions with this velocity and an energy of 10 eV is, again, deduced from Eq. (2) to be about 49 amu. Therefore, with the minimum time delay of 3.73 uS required to eliminate mass 4 amu ions from the analysis, the mass range accepted by the time-of-flight accelerator is 6.9 amu to 49 amu. Such a mass range obviously does not meet the analysis requirement to measure masses over a range of 35 to 300 amu. In order to accept mass 300 amu ion packets as the largest mass, the time delay less the ionization duration must be no shorter than the time it takes the trailing edge of the mass 300 amu ion packet to just pass the entrance to the acceleration region. For a 300 amu ion at an energy of 10 eV to travel a distance of 2 cm requires a time of 7.88 uS, according to Eq. (2). With an ionization pulse of 1 uS, this corresponds to a minimum delay time of 8.88 uS. For this delay time, then, the lightest mass that is fully accepted corresponds to an ion mass with a velocity of (7 cm /8.88 uS) at an energy of 10 eV, which corresponds to an ion mass of 31.1 amu. With these parameters, then, the entire analytical mass range of interest is measured, while the detrimental intense ions at lower masses is eliminated.

Figure 3:
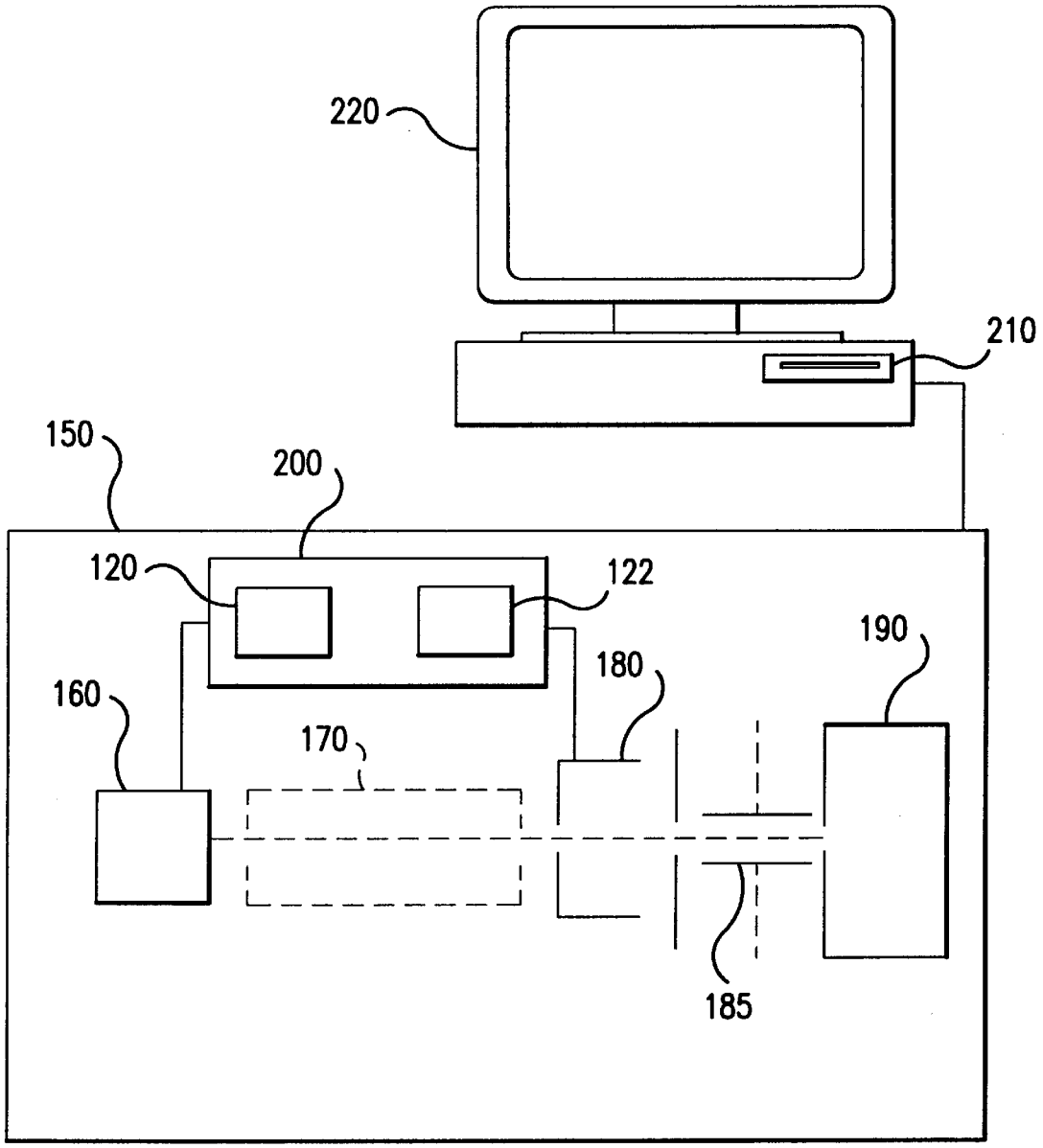
FIG. 3 is a block diagram of another embodiment, depicting a mass spectrometer incorporating the ionizer, an ion transfer region, a linear accelerator and a detector or mass analyzer.

Various accelerator configurations may be used in the present invention. FIG. 2 depicts an embodiment of the invention utilizing an orthogonal accelerator, while FIG. 3 depicts a mass analyzer in combination with an embodiment of the invention using a linear accelerator.

In summary, the invention disclosed herein provides a novel means and method for extending the dynamic range in the time-of-flight mass analyzer. Advantages of this invention relative to alternative methods 1) th relative amount of gain change is known precisely a priori so as to allow quantitative interpretation of signal levels with negligible additional effort; 2) the gain is adjustable with a time resolution compatible with 'fast' chromatographic response times; and 3) the gain adjustment is realized with minimal additional expense and complexity. In addition, this invention allows a well defined segment of the spectrum ion masses emanating from the ion source to be selected for analysis, with the additional advantage that: 4) segments of the mass spectrum that contain relatively intense ions can be removed from the ion flux in the mass spectrometer, thereby eliminating any possible disturbing effects due to them.

We claim:

1. A mass spectrometer, comprising:

an ion source including:

an electron source for generating a flow of electrons;

a gate electrode constructed so as to block said flow of electrons when a potential is applied;

a sample introduction means for transporting at least one analyte;

an ionization chamber having at least a first input, a second input and at least one output, said first input being for receiving said flow of electrons from said gate electrode, and said second input being for receiving said at least one analyte from said sample introduction means, wherein said flow of electrons ionizes said at least one analyte and said ionized at least one analyte is emitted from said at least one output;

a pulsed accelerator;

an ion transfer region interposed between said at least one output of said ionization chamber and said accelerator so that ions of said ionized at least one analyte travel from said ionization chamber output, through said ion transfer region and into said accelerator, said ions spatially separating by mass in said ion transfer region before being accelerated by said accelerator;

means for controlling said gate electrode and said pulsed accelerator in a time relationship so as to control flow of said ions traveling into said accelerator between accelerator pulses to improve the dynamic range of said mass spectrometer and to selectively accelerate a particular mass range.

2. The apparatus of claim 1 wherein the means for controlling said gate electrode and said pulsed accelerator is a plurality of synchronized signal generators.

3. The apparatus of claim 2 wherein said signal generator is a pulse generator.

4. The apparatus of claim 1 wherein said mass spectrometer is controlled by program means residing in a digital computer.

5. The apparatus of claim 1 wherein said pulsed accelerator is a linear accelerator.

6. The apparatus of claim 1 wherein said pulsed accelerator is an orthogonal accelerator.

7. The apparatus in claim 1 wherein said means for controlling said gate electrode and said pulsed accelerator in a timed relationship further comprises means for controlling the pulse duration applied to said gate electrode.

8. The apparatus in claim 1 wherein said means for controlling said gate electrode and said pulsed accelerator in a timed relationship further comprises means for controlling the number of pulses applied to said gate electrode.

9. The apparatus of claim 1, wherein said at least one analyte is contained in a carrier gas and at least a portion of said carrier gas is ionized with said analyte.

10. The apparatus of claim 1, wherein said spatially separating and said timed relationship cause only a selected mass range to be accelerated by said accelerator.

11. The apparatus of claim 10, further comprising an ion detector, wherein only said selected range reaches said detector.

12. In a mass spectrometer, a method for improving the dynamic range and selecting a mass range for analysis comprising:

generating a flow of electrons;

modulating said flow of electrons;

providing a sample containing at least one analyte;

ionizing said at least one analyte with said modulated flow of electrons to produce ions;

allowing said ions to travel through an ion transfer region and into a pulsed accelerator, so that said ions are spatially separated by mass in said ion transfer region before being accelerated by said accelerator;

controlling said modulation and said pulsed accelerator in a timed relationship so as to control flow of said ions traveling into said accelerator between accelerator pulses to improve the dynamic range of said mass spectrometer and to selectively accelerate a particular mass range.

13. The method of claim 12 further comprising utilizing said method in a mass spectrometer having an ion source and an ion mass analyzer.

14. The method of claim 13 further comprising utilizing program means residing in a digital computer to control said mass spectrometer.

15. The apparatus of claim 12 wherein said acceleration of a particular mass range is linear.

16. The apparatus of claim 12, wherein said acceleration of a particular mass range is orthogonal.

17. The method of claim 12 wherein controlling said modulation of said flow of electrons and said pulsed accelerator in a timed relationship further comprises controlling the pulse duration of said modulation.

18. The method of claim 12 wherein controlling said modulation of said flow of electrons and said pulsed accelerator in a timed relationship further comprises controlling the number of pulses of said modulation.

19. The method of claim 12, wherein said at least one analyte is contained in a carrier gas, and at least a portion of said carrier gas is ionized with said at least one analyte.

20. The method of claim 12, wherein said spatially separating and said timed relationship cause only a selected mass range to be accelerated by said accelerator.

21. The method of claim 20, wherein said ions are accelerated to an ion detector and only said selected range reaches said detector.

22. The method of claim 12, wherein said modulating is controlled to change the number of said ions that are accelerated by said accelerator to a detector.

23. The method of claim 22 wherein said modulating is controlled so that said detector is not saturated by said ions.

24. The method of claim 22 further comprising analyzing a mass spectrum peak which cannot be accommodated within the dynamic range of said detector by taking into account a known factor in modulation time between a modulation pulse associated with the peak that cannot be accommodated, and a modulation pulse associated with a peak that can be accommodated within the dynamic range of said detector.

25. A mass spectrometer comprising:

a sample introduction system for introducing a sample containing at least one analyte;

a pulsed ion source for ionizing said at least one analyte in said sample;

a pulsed accelerator;

an ion transfer region interposed between said ion source and said accelerator so that ions of said at least one analyte travel from said pulsed ion source to said accelerator, said ions spatially separating by mass in said ion transfer region before being accelerated by said accelerator;

means for controlling said pulsed ion source and said pulsed accelerator in a timed relationship so as to control flow of said ions travelling into said accelerator between accelerator pulses to selectively accelerate a particular mass range when said accelerator is pulsed.

26. The apparatus of claim 25 further comprising means for modulating said pulsed ion source.

27. The apparatus of claim 25 further comprising an ion detector, said mean for modulating controlling pulse width of said ion source to change the number of said ions accelerated by said accelerator to said detector.

28. The apparatus of claim 27 wherein said pulse width is controlled so that said detector is not saturated by said ions.

29. A method for operating a mass spectrometer including a pulsed ion source and a pulsed accelerator, said method comprising:

introducing a sample containing at least one analyte into said mass spectrometer;

pulsing said ion source to ionize said at least one analyte;

causing said ions to enter an ion transfer region interposed between said ion source and said accelerator so that ions of said at least one analyte travel from said pulsed ion source to said accelerator, said ions spatially separating by mass in said ion transfer region before being accelerated by said accelerator;

controlling said pulsed ion source and said pulsed accelerator in a timed relationship so as to control flow of said ions travelling into said accelerator between accelerator pulses to selectively accelerate a particular mass range when said accelerator is pulsed.

30. The method of claim 29 further comprising controlling pulse width of said ion source.

31. The method of claim 30 wherein said mass spectrometer further includes a detector for detecting said ions, and wherein said pulse width is controlled to change the number of said ions that are accelerated by said accelerator to said detector.

32. The method of claim 29, wherein said modulating is controlled so that said detector is not saturated by said ions.

33. The method of claim 29, further comprising analyzing a mass spectrum peak which cannot be accommodated within the dynamic range of said detector by taking into account a known factor in modulation time between a modulation pulse associated with the peak that cannot be accommodated, and a modulation pulse associated with a peak that can be accommodated within the dynamic range of said detector.

* * * * *